United States Patent [19]

Fichtl et al.

[11] 3,936,327

[45] Feb. 3, 1976

[54] BORIDING COMPOSITION

[75] Inventors: Walter Fichtl, Buttgen-Vorst; Gunter Wiebke, Munich; Helmut Kunst, Hanau, Hohe Tanne; Alfred Graf von Matuschka, Eschenried; Georg Bachmann, Berrendorf; Alfred Lipp, Bad Worishofen, all of Germany

[73] Assignee: Elektroschmelzwerk Kempten GmbH, Munich, Germany

[22] Filed: June 10, 1974

[21] Appl. No.: 478,110

Related U.S. Application Data

[63] Continuation-in-part of Ser. No. 287,093, Sept. 7, 1972, abandoned.

[52] U.S. Cl. ..... 148/27; 148/15.5; 148/16.5; 148/16.6; 427/253

[51] Int. Cl.[2] ..... B23K 35/24

[58] Field of Search ..... 148/27, 6, 6.11, 6.35, 148/15.5, 20, 30, 31.5; 117/102 R, 107.2 P; 427/252, 253

[56] References Cited

UNITED STATES PATENTS

| | | | |
|---|---|---|---|
| 3,090,702 | 5/1963 | Commanday et al. | 117/107.2 P |
| 3,222,228 | 12/1965 | Stanley et al. | 148/16 |
| 3,622,374 | 11/1971 | Pike | 117/107.2 P |
| 3,673,005 | 6/1972 | Kunst | 148/6 |
| 3,806,374 | 4/1974 | Krzyminski | 148/6.35 |
| 3,809,583 | 5/1974 | Krzyminski | 148/6.35 |

OTHER PUBLICATIONS

Fiedler, et al., *Boriding Steels, in Metal Progress*, Feb. 1971, pp. 101–107.

*Primary Examiner*—Walter R. Satterfield
*Attorney, Agent, or Firm*—Francis M. Crawford

[57] ABSTRACT

The present invention relates to powdered boriding compositions for the production of single-phase boride layers on metal articles being substantially free from cracks in the case of mechanical stress, which comprise an activator and a mixture of a boron-releasing agent and an unreactive refractory material, such as silicon carbide.

7 Claims, No Drawings

BORIDING COMPOSITION

The present application is a continuation-in part application based on our U.S. Ser. No. 287,093, filed Sept. 7, 1972, now abandoned.

The present invention relates to a powdered boriding composition for the production of single-phase boride layers, substantially free from cracks, on metal articles, which comprises an activator and a mixture of a boron-releasing agent and an unreactive, refractory material, said unrefractory material being present in said mixture in amounts of 75 – 99.5%, by weight, based on the weight of said mixture. More particularly, it relates to conventional boriding compositions containing a boron-releasing agent and an unreactive, refractory material in said specified ratios.

The production of very hard surfaces of borides on metal articles by diffusion of boron into the surfaces thereof, has long been known. For this purpose it is possible, for example, to use gaseous boriding agents, such as diborane, boron halides, and organic boron compounds, as well as liquid substances, such as borax melts, with viscosity-reducing additives, with or without the use of electric current. The use of such boriding agents, however, has never gained commercial importance due to the fact that they are not very economical, they are partially toxic, and because of the non-uniformity of the boride layers obtained therewith.

Solid boriding agents based on boron-releasing compounds, such as boron carbide, amorphous boron or ferrocarbon, together with activating additives, such as alkali metal or ammonium borofluorides, can be handled more easily and above all do not represent any hazard to the environment.

A particular disadvantage of the boriding procedure of the prior art consists in the fact that their use results in the formation of poly-phase boride layers having undesirable properties. For example, when boriding iron articles the initial formation of $Fe_2B$ is followed by a second phase, richer in boron, which starts from the surface of the $Fe_2B$-phase and consists of FeB, after the temperature and time has been exceeded, both of which are specific to the particular metal being borided.

However, this second phase is undesirable for technical reasons though its Vickers-hardness ($HV_{0.2}$) is about 100 kp/mm$^2$ higher, because it is disproportionately more brittle than the $Fe_2B$-phase. Because of this fact differently directed tensions exist between the two phases, which cause cracks and burstings in/of the layer in the case of mechanical stress.

It has now been discovered, in accordance with the present invention, that substantially crack-free, single-phase boride layers on metal articles can be formed which are substantially free from the disadvantages of the prior art boriding processes and agents therefor. These desirable effects are obtained by using boriding compositions in which the ratio of the boron-releasing agent is materially reduced by the incorporation in said boriding compositions of substantially increased proportions of unreactive refractory materials.

Using the boriding composition according to the invention it is possible, for example, when boriding iron articles, to prevent the formation of undesired FeB even with prolonged boriding times and at higher temperatures which are sometimes necessary when a thicker boride layer is required for special applications.

Whilst it was necessary to determine optimum treatment conditions for each material in the hitherto known procedures, that is to say to determine certain limiting values of the temperature and time, above which a second phase begins to form, it proves possible, using the boriding composition according to the invention, to obtain the desired singlephases of low boron content, in substantial layer thicknesses, even at higher temperatures and with longer boriding times. This effects substantial savings in boriding operations and at the same time gives boride layers of substantially improved properties.

The powdered boriding composition for the production of single-phase boride layers, substantially free from cracks, on metal articles, according to the invention comprises an activator and a mixture of a boron-releasing agent and an unreactive refractory material, said refractory material being present in said mixture in amounts of 75 – 99,5 % by weight, based on the weight of said mixture.

The composition according to the invention can comprise any conventional type of metal borofluoride as an activator, alkali borofluorides, such as sodium borofluoride, potassium borofluoride, and ammonium borofluoride are preferred. The amount in which the activator is present in the composition can range from 1 to 10 % by weight, based on the total weight of the composition. Most preferred as activator is potassium borofluoride ($KBF_4$) being present in the amount of 5 % by weight, based on the total weight of the composition. The composition according to the invention can comprise any conventional type of a boron-releasing agent, such as boron carbide, amorphous boron and ferro boron; boron carbide is preferred.

The composition according to the invention comprises said boron-releasing agent in admixture with a refractory material, which is unreactive under boriding conditions, that means that the proper boron-releasing agent is partially replaced by an unreactive material, and that is the critical feature by which the composition according to the invention is distinguished of the solid boriding agents of the prior art. Silicon carbide is the preferred unreactive, refractory material, suitable for use in said mixture with the boron-releasing agent. Furthermore, free carbon can be used, which may also be present as an impurity in technical products. Said refractory material, such as silicon carbide has to be present in said mixture in amounts of 75 to 99,5 % by weight, preferably in the amount of about 95 % by weight, based on the weight of said mixture.

The solid boriding agents of the prior art have usually contained borax in concentration ranging from 12 to 60 % by weight. It has been stated, however, that borax alone is not sufficient to react as a boron-releasing agent when used with the unreactive refractory material under the conditions of the invention. The composition according to the invention can therefor comprise borax in an amount up to 16 % by weight, based on the total weight of the composition provided that at least one of the above mentioned boron-releasing agents is present. In such a case the use of borax does not affect adversely the formation of a single-phase boride layer on metals. The borax however melts during the heat treatment required for the boriding step and wets the non-melting portions of the solid boriding agent. After completion of the boriding step and cooling of the treated article a solid sintered cake is formed which must be removed from the borided article after soaking in warm water. Such cleaning operation materially increases the cost of the borided article, particularly when the latter are complicated in shape and are manufactured by mass production.

In the boriding composition according to the present invention the borax content is therefor preferably reduced to 4 to 0% and most preferably to 0% by weight, making it possible to remove much more easily the residues on the borided articles. An additional advantage results from the fact that the recovery and reutilization of the boriding composition of the present invention can be much more readily and economically effected. These advantages together with the improved properties of the single-phase crack-free boride layers produced with less operation control make the improvement of the present invention particularly important from an economic point of view.

The metal articles which can be borided with the powdered boriding composition according to the invention include articles of any shape consisting of iron, steel, nickel, titanium and the like.

The following specific examples are intended to illustrate the invention but in no manner to limit the broad disclosure hereinabove set forth.

EXAMPLE 1

(Comparison)

A plate of unaloyed quenched and tempered steel of the quality St 37 was borided by heating for 4 hours at 900°C in the following boriding composition:

79 % by weight of boron carbide
16 % by weight of borax
5 % by weight of potassium borofluoride After heating the composition was sintered into a solid cake. A micrograph of the borided steel plate prepared as above described, showed a typical two-phase boride layer consisting of the intermetallic phases $Fe_2B$ and FeB, each showing "teeth" vertically oriented to the surface. A continuous crack was clearly visible and developed by the mechanical stress produced by the cutting disc. The layer had burst off at various points. The total thickness of the borided layer was 170 microns, 75 microns of which was FeB.

The above results clearly showed that when using a prior art boriding composition consisting of boron carbide as the boron-releasing compound, an activator such as potassium borofluoride and borax the resulting borided plate was quite unsatisfactory.

EXAMPLE 2

The operation described in Example 1 was repeated with the exception that the amount of boron-releasing compound was reduced to 3.95 % by weight, and 75,05 % by weight of an unreactive refractory, silicon carbide was added to the mixture, which had the following composition:

3.95 % by weight of boron carbide
75.05 % by weight of silicon carbide
16.0 % by weight of borax
5.0 % by weight of potassium borofluoride (95 % of the boron-releasing compound, boron carbide was replaced by the unreactive refractory, silicon carbide).

A micrograph of the resulting borided plate showed that it contained only a single-phase boride layer consisting essentially of only the intermetallic phase $Fe_2B$ with teeth vertically oriented to the surface. The thickness of the boride layer was 110 microns. No cracks were visible which could have been developed by the mechanical stress when cutting by means of a cutting disc. Due to avoiding the formation of a second phase no cracks were formed in the case of mechanical stress. The use of borax does not affect adversely the formation of a single-phase layer. It caused, however, sintering of the composition which required an additional cleaning step with hot water.

EXAMPLE 3

This experiment was run under the same conditions as Experiment 1 using a boriding composition consisting of:

4.75 % by weight of boron carbide
90.25 % by weight of silicon carbide
0.00 % by weight of borax
5.00 % by weight of potassium borofluoride (95 % by weight of the boron-releasing compound, boron carbide, was replaced by unreactive refractory, silicon carbide).

After the above treatment the resulting composition was not sintered to a solid cake, as when 16 % of borax was used, but crumbled apart when tapped slightly. The lumps could be ground between the fingers into a powder, which could be reused for boriding purposes. The surface of the borided sample was completely free from glass-like molten attachments and there was no need to cleanse it with warm water. A micrograph showed a single-phase boride layer consisting only of the intermetallic phase $Fe_2B$ forming teeth vertically oriented to the surface, the thickness of the layer being 120 microns. No cracks were visible that could have been developed by the mechanical stress when cutting by means of the cutting disc.

EXAMPLE 4

In this experiment all of the conditions were the same as in Experiment 3 with the exception of the fact that the temperature was increased to 1000°C and the time to 6 hours.

The properties of the resulting borided sample did not differ appreciably from those of the sample in Example 3. A micrograph showed a single-phase boride layer consisting only of the intermetallic phase $Fe_2B$ having teeth oriented vertically to the surface. The thickness of the layer was 300 microns. No cracks were visible that could have been developed by means of the cutting disc. This test showed that the only substantial different result obtained was in producing a thicker layer.

EXAMPLE 5

(comparison)

In this experiment the conditions were the same as in Example 1 with the exception that the composition used consisted of 0.00 % by weight of boron carbide
79.00 % by weight of silicon carbide
16.00 % by weight of borax
5.00 % by weight of potassium borofluoride The resulting sample contained an interrupted boride layer with only partially formed teeth vertically orientated to the surface, showing that a continuous boride layer was not formed. This shows that borax alone is not sufficient to react as a boron-releasing agent when used with the unreactive refractory material, silicon carbide under the conditions of the invention.

EXAMPLE 6

In this experiment a plate of electrolytic nickel was heated for 4 hours at 900°C in the following boriding composition:

3.95 % by weight of boron carbide
75.05 % by weight of silicon carbide
16.0 % by weight of borax
5.0 % by weight of potassium borofluoride (95 % of the boron-releasing compound, boron carbide was replaced by the unreactive, refractory silicon carbide). The resulting borided sample contained a single-phase layer 60 microns thick and contained no flaws.

Experiment 7

In this experiment a titanium plate was treated for 6 hours at 1100°C in the boriding composition shown in Example 6, using argon gas as a protective gas. A single-phase boride layer of 15 microns thickness was obtained showing substantially no cracks.

Experiment 8

In this experiment a plate of steel, of the quality St 37, was heated for a period of 4 hours at 900°C in a boriding mixture consisting of:

4.5 % by weight of boron carbide
86.5 % by weight of silicon carbide
4.0 % by weight of borax
5.0 % by weight of potassium borofluoride (95,05 % of the boron-releasing compound, boron carbide was replaced by the unreactive, refractory silicon carbide).

The resulting single-phase boride layer was free from cracks and 120 microns in thickness. The lumps of solid boriding agent could be crumpled between fingers. Very few deposits of borax were noted and their size was small.

What is claimed is:

1. Powdered boriding composition which consists essentially of 1 - 10%, by weight, of an activator selected from the group consisting of alkali metal and ammonium borofluorides, and a mixture of 75 – 99.5%, by weight, of silicon carbide and 25 – 0.5%, by weight, of a boron-releasing agent selected from the group consisting of boron carbide, amorphous boron and ferroboron, based on the total weight of said mixture.

2. The powdered boriding composition according to claim 1, wherein said boron-releasing agent is boron carbide.

3. The powdered boriding composition according to claim 1 wherein said activator is present in said composition in the amount of 5%, by weight, based on the total weight of said composition.

4. The powdered boriding composition according to claim 1, wherein said composition may contain 16 –0%, by weight of borax.

5. The powdered boriding composition according to claim 1, wherein said composition may contain 4 – 0%, by weight of borax.

6. The powdered boriding composition according to claim 1, wherein said silicon carbide is present in said composition in the amount of 95%, by weight, based on the total weight of said composition.

7. The powdered boriding composition according to claim 1, consisting essentially of:

5%, by weight, of potassium borofluoride,
3.95 – 4.75%, by weight, of boron carbide,
75.05 – 90.25%, by weight, of silicon carbide,
16 – 0%, by weight, of borax.

* * * * *